United States Patent [19]

Sprague

[11] 4,087,102

[45] May 2, 1978

[54] HAND CARRYABLE TRAVEL CONTAINER CONVERTABLE TO ROLLABLE CART

[76] Inventor: Stephen B. Sprague, 1135 W. Hamilton Ave., Campbell, Calif. 95008

[21] Appl. No.: 748,490

[22] Filed: Dec. 8, 1976

[51] Int. Cl.[2] ..... B62B 3/02

[52] U.S. Cl. ..... 280/37; 190/18 A; 280/40

[58] Field of Search ..... 280/37, 40, 655, 652; 190/18 A

[56] References Cited

U.S. PATENT DOCUMENTS

| | | | |
|---|---|---|---|
| 2,581,417 | 1/1952 | Jones | 190/18 A |
| 2,602,675 | 7/1952 | Forman | 280/655 |
| 3,842,953 | 10/1974 | Royet | 190/18 A |

FOREIGN PATENT DOCUMENTS

| | | | |
|---|---|---|---|
| 1,099,200 | 1/1968 | United Kingdom | 190/18 A |

*Primary Examiner*—Bruce H. Stoner, Jr.
*Assistant Examiner*—Michael J. Forman
*Attorney, Agent, or Firm*—Howard L. Johnson

[57] ABSTRACT

A support pallet carrying at opposite ends thereof, jointly extensible tow-handle and pair of rollers, which pallet can form original-construction false bottom of luggage container such as suit case, or as free form can be extended to form hand cart for manually moving one or several containers. Operating mechanism comprises parallel pair of oppositely (90°) twisted, flat-faced rigid ribbons each simultaneously rotatable on its longitudinal axis and lengthwise forming a helical slide track. Each track is transversely engaged jointly by a bifurcate-ended, slide yoke forming a distal cross arm of a lengthwise displaceable tow handle. Distal end of each track-ribbon is attached to a ground-support roller, which rollers are jointly movable by transverse pivoting between housed and functional positions effected by longitudinal movement of cross-arm-yoke and tow handle. Independently carryable container or alternately flat-collapsed pallet unit, upon conversion to pull cart form, can carry multiple containers or objects stacked or bound to upper transverse face. Retraction of rollers and pull handle makes unit storable like ordinary rectangular box.

6 Claims, 12 Drawing Figures

HAND CARRYABLE TRAVEL CONTAINER CONVERTABLE TO ROLLABLE CART

BACKGROUND OF THE INVENTION

Recurrant occasions which have required travellers to handle their own luggage in walking between marshalling area and transport vehicle such as aircraft, ship, train, bus, etc. have prompted the introduction of (a) collapsible wheel/frame units intended to form a "cart" when attached to a luggage piece, and (b) rollers permanently connected to a suit case or the like. With the latter, the continued presence of the rollers are objectionable when stowing the article; in addition, their presence only accommodates the single container. With a collapsible unit, it is usually unwieldy when separate, and its quick and "effortless" coupling to a luggage piece often proves to be imaginary. Beyond this, the presence of steep grade, steps or other hazards to a free rolling object, make it desirable that such a rolling container (a) be capable of control and guidance by the traveller, (b) be capable of carrying more than one piece of luggage at the same time, (c) be convertable back to a non-rolling container.

STATEMENT OF THE INVENTION

The foregoing objects and related advantages are achieved by the present construction which provides a pallet assembly having a pair of wheels or rollers near one end and a guidance-tow handle adjacent the other end, both of which (handle and wheels) are simultaneously extensible and retractable by a common operating mechanism. The latter comprises a parallel pair of (preferably) oppositely twisted, flat-faced, rigid ribbons or straps, each of which forms a (quarter-turn or 90°) helical track along its length and is rotatable on terminal pivot pins which thus define its longitudinal axis. Both tracks are slidingly engaged by a bifurcate-ended cross yoke which by its movement lengthwise to the tracks, causes the latter to rotate simultaneously (e.g. a quarter turn). Each ribbon or track radially supports a roller adjacent its distal end, and such rotation shifts the pair of rollers to and from a ground-contact position, in response to lengthwise movement of the yoke-connected tow handle.

When the ribbons are oppositely twisted, the pair of rollers turn or fold toward and away from each other. However it will be apparent that the two tracks could both twist the same way (i.e. mutually parallel), and also that the shift between housed and functional position can be either greater or less than 90°.

The pallet assembly by itself (as by addition of an edge baffle or ledge) can form a hand cart of any size. Alternately it can be built into a luggage (or other) container such as a suitcase, constituting a false bottom with the rollers thus extensible through corresponding openings of a true bottom which latter can also serve as a slide surface when the wheels (and tow handle) are retracted. That is, the container can then be allowed to slide down a delivery chute on such face, where the chute might be too steep to permit use of the rollers. Also, the permanently projecting rollers and handle would be objectionable in stacking and storage of the container. However when such a container, hand carryable when its wide walls are disposed upright, is tilted transversely a quarter-turn and its rollers and tow-handle extended, it now constitutes a "hand cart" which can have additional containers or pieces of luggage piled upon its upper face and the whole rolled along the chosen course by the traveller. Thus the traveller with one such retractable-roller suitcase and several other baggage pieces, will be able to push or pull them all as a single unit, and without hand carrying any of them. At the same time, at the end of the path, each one of the articles will be able to be stacked in the normal manner.

BRIEF DESCRIPTION OF THE DRAWINGS

As shown in FIGS. 1-5, the present pallet assembly may be incorporated in a typical luggage container C of generally rectangular shape, by forming a pallet or surface support 12 with similar peripheral configuration as the container and locating it as a false bottom spaced from a wide surface of the container, that is, opposite and parallel to a hinged cover 14. The latter hinged along one long edge, carries a couple of latch members 15, 16 adjacent its opposite long edge and a grip handle 18 is mounted medially along an upper, narrow longitudinal wall 19 for carrying the container when the wide walls are disposed in upright position. A second wide wall 20 forms the true bottom wall, and is thus spaced a short distance from the pallet/false bottom 12, being connected to the cover 14 by encircling narrow walls which define a storage chamber 21 of the container proper, and an operating chamber 23 containing the pallet-supported elements. Both chambers 21, 23 are laterally enclosed by the narrow walls 19 (top), 22 (bottom), 24 (distal end), and 26 (proximate end—FIG. 2). The latter 26, below the pallet wall 12 is transversely connected to intermediate segments 30, 31 which form sides of an outward-open housing recess 34 which inwardly is closed by an anchorage cross-bar 32. The latter is transversely apertured for sliding insertion of parallel side arms 27, 28 of a tow handle H, of which the cross handle 29 is housingly receivable within the recess 34, when the unit H is retracted as for storage. Adjacent the distal end, the bottom wall 20 is formed with a pair of mutually-facing bulbous-ended apertures 36, 38 overlying the housed rollers as hereafter detailed.

Figure 5:
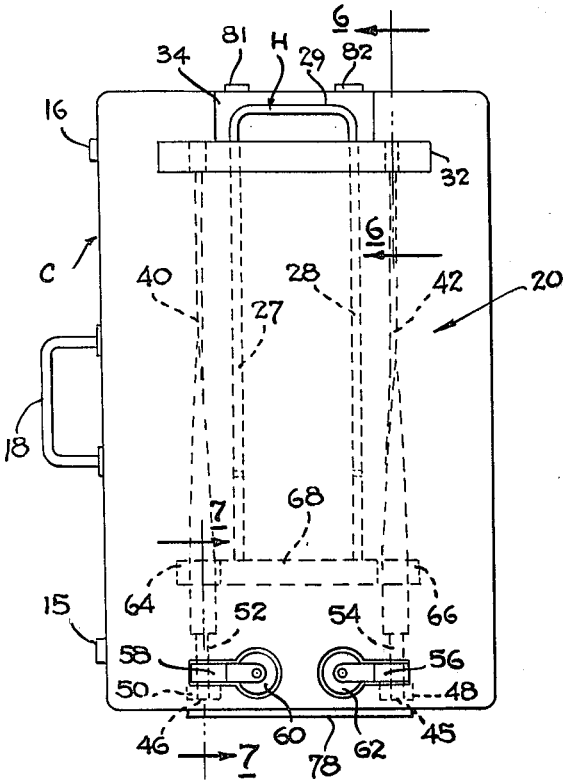
FIG. 5 is a bottom face view similar to FIG. 2 but with the pair of rollers and tow-handle in retracted positions.
Figure 6:
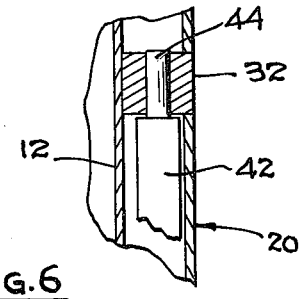
FIG. 6 is a sectional detail taken on line 6—6 of FIG. 5, showing mounting of the terminal pivot pin of a track element.

Within the housing cavity 23 formed between the bottom wall 20 and the support pallet 12, the lower face of the latter carries a parallel pair of longitudinal slide tracks 40, 42, each axially projecting a bearing stud or pin from each end 43, 44, 45, 46 (FIGS. 5–7), the proximate pair of pins being journalled in the cross bar 32, and the distal pair in respective anchorage blocks 48, 50. A penultimate, cylindrical segment 52, 54, of each track carries a fixed collar 56, 58 radially projecting a bifurcate arm which disposes a ground-contact anti-friction element such as a roller or wheel 60, 62 in position to be extensible through the respective bottom-face apertures 36, 38 upon corresponding rotation of the tracks 40, 42.

Each track is a flat-faced (metal) bar or rigid ribbon formed by progressively and uniformly twisting its length into a helical pattern or shape, in this case, a quarter helix or 90° twist. The two helical tracks are oppositely curved or twisted (i.e. clockwise and counterclockwise respectively) and are simultaneously engaged by respective bifurcate ends 64, 66 of a slidable yoke control member 68. The latter is fastened, as by nuts 70, 72 to the ends of parallel arms 27, 28 of the U-shape tow unit H, by which unit the yoke is movable lengthwise to the tracks 40, 42, by such movement rotating them on their end bearings and swinging the carried rollers in or out.

Figure 8:
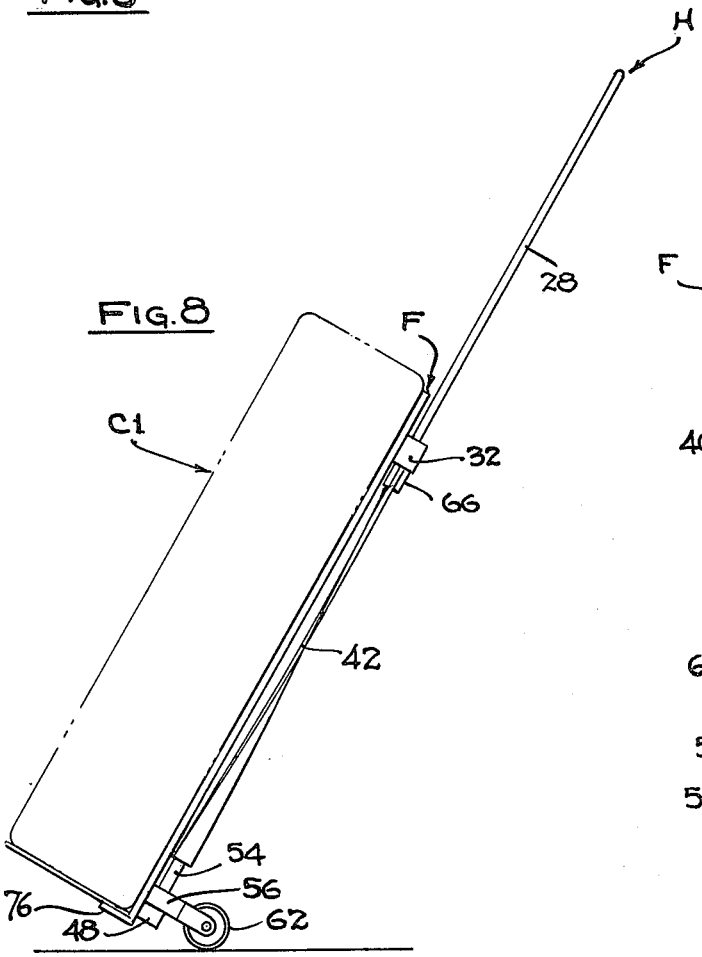
FIG. 8 is a side elevational view of a pallet assembly forming a hand cart by itself, with a carried container indicated in phantom.
Figure 9:
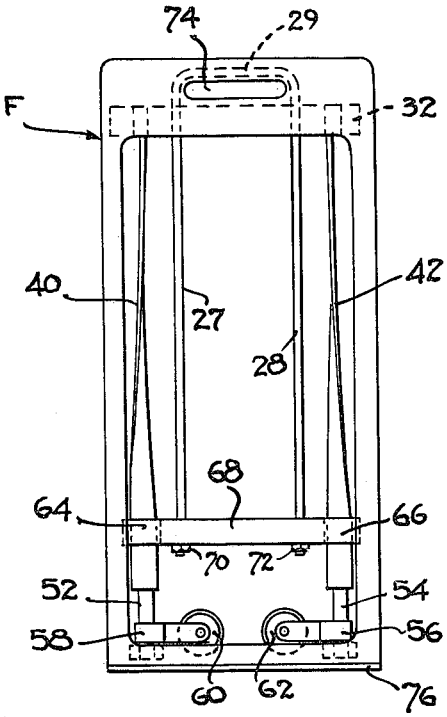
FIG. 9 is a rear face view of the assembly of FIG. 8 with the rollers and tow handle in retracted position.

By the construction shown in FIGS. 8–9, the pallet assembly is fixed to an open-center frame F (in place of the solid pallet 12), the frame having a hand opening 74 at the proximate or grab end, and a baggage abutment ledge or baffle 76 upstanding across the distal margin. Temporary restraining straps or cords may be jointly wrapped about the container C1 and support frame F, and fastened by interengaging "velcro" type elements, especially when several cartons are loaded on the pallet.

Figure 1:
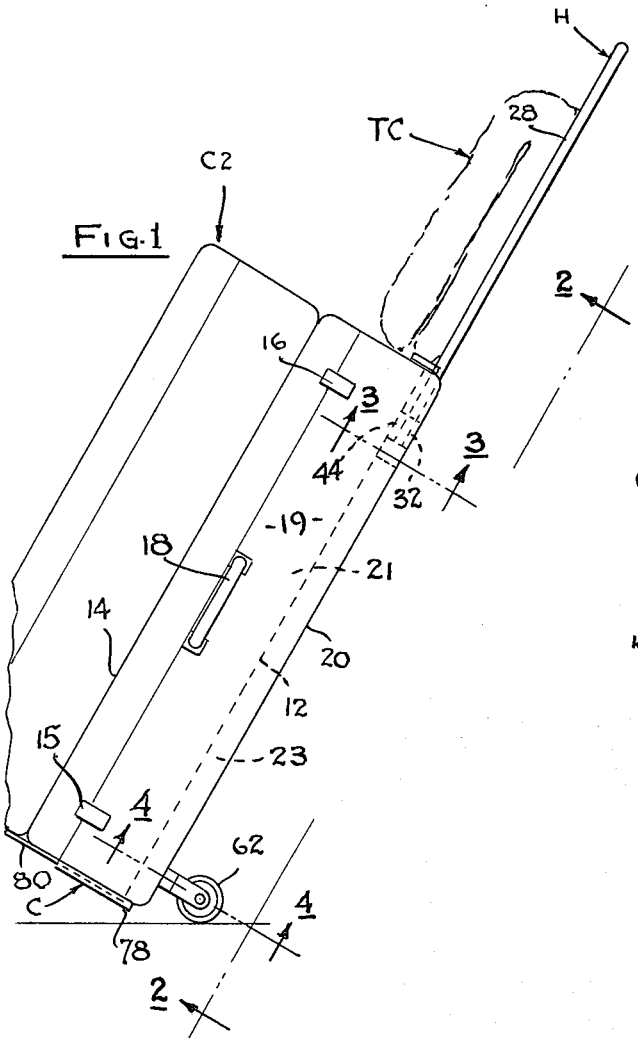
FIG. 1 is a side elevational view of a piece of hand luggage constructed with a false bottom housing the present retractable rollers and tow-handle which latter appear in extended position.
Figure 2:
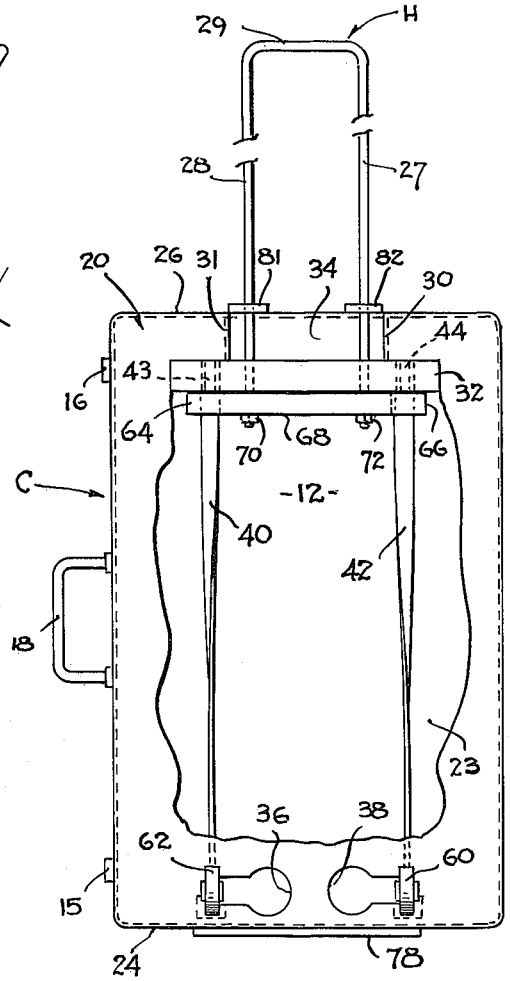
FIG. 2 is a bottom face view of the same with a portion of the bottom wall broken away to show the pair of helically twisted slide rails and the operating yoke, as viewed along line 2—2 of FIG. 1.

Adjacent the closed-end wall 24 of the container body C is a housing sheath 78 which holds a slide plate 80 which may be drawn out as seen in FIG. 1 to provide an end abutment for a second container C2 placed on top of the now-rollable container C. The upper ends of the two containers (when of the same length) may have a smaller carton or article such as a trench coat TC stacked on this surface, or the coat may be laid crosswise to the handle bars 27, 28. Thus stacked, the traveller may push or pull the assembly by one hand, and still have the other arm free to carry a hand bag if necessary. A pair of spring-loaded latch members 81, 82 are each located to engage a notch of the respective handle bar 27, 28 so as to prevent the tow bar H from self-retraction when using it to push the unit.

Figure 10:
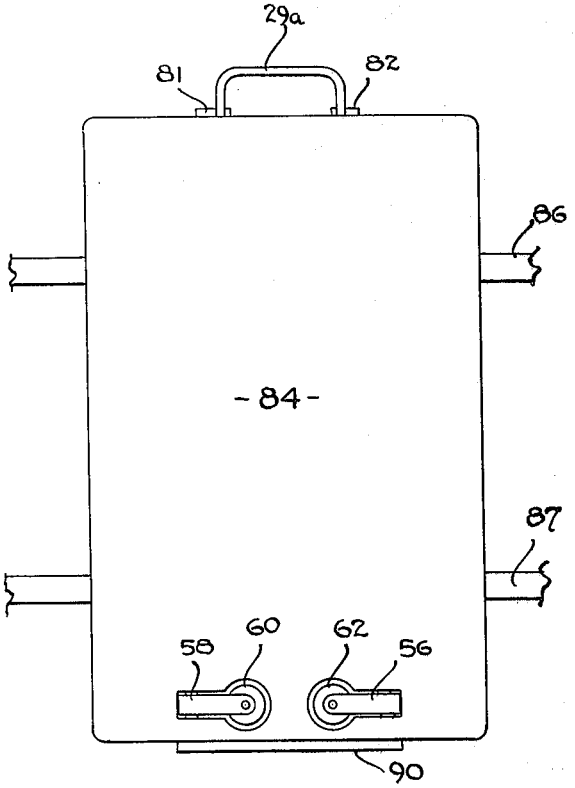
FIGS. 10 and 12 are respectively rear and front face views of a completely enclosely pallet construction with outspread straps.
Figure 11:
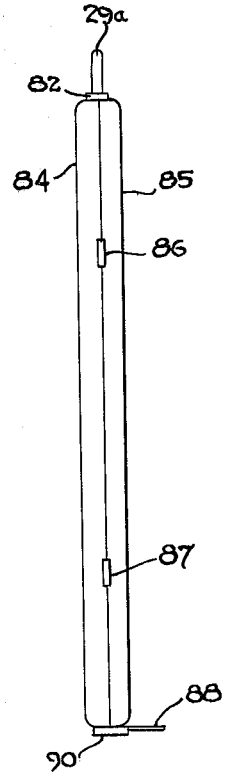
FIG. 11 is an edge elevational view thereof.
Figure 12:
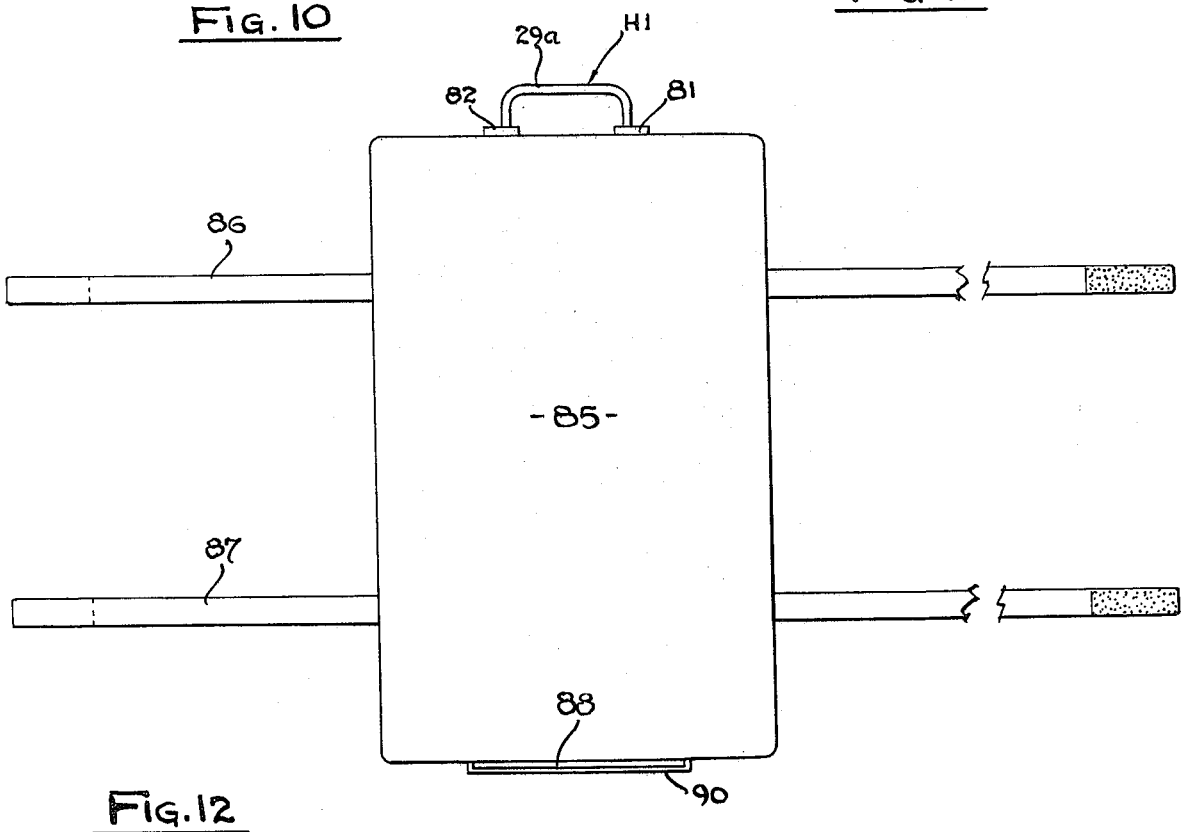

The construction of FIGS. 10–12 in effect modifies the FIGS. 8–9 construction by providing a complete, externally flat-faced housing for the wheels and operating mechanism. The housing is formed of a pair of molded, edge-joined, plastic shells 84, 85 of which one (84) corresponds to the pallet 12 described earlier. From the longitudinal junction line of the two shells a pair of straps 86, 87 project from each side, the terminal lengths of which are faced with interengagable hooks and loops, commonly known as "velcro", by which corresponding ends can be held together after being drawn tight when overlying a container or object placed against the pallet face 85. A toe plate or abutment ledge 88 is extensible from a transverse housing sheath 90. The cross bar *29a* in this construction is located so as to remain projecting a short distance and thus provide a carrying handle when the slide yoke and rollers 60, 62 are retracted.

Figure 3:
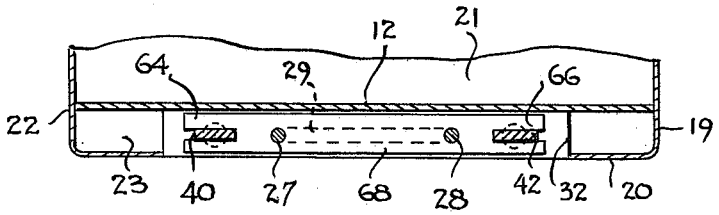
FIG. 3 is a transverse section through the pair of track elements taken on line 3—3 of FIG. 1.
Figure 4:
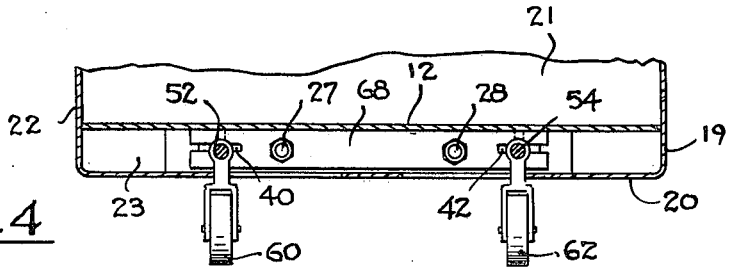
FIG. 4 is a transverse section through the extended roller assembly taken on line 4—4 of FIG. 1.
Figure 7:
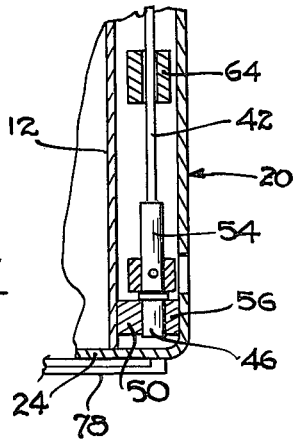
FIG. 7 is a sectional detail taken on line 7—7 of FIG. 5, showing in section one bifurcate slide engagement end of the cross yoke.

While particular reference has been made to incorporation of the pallet construction in traveller's luggage or containers for personal effects, it will be clear that containers into which the present pallet and wheel assembly can be incorporated include such examples as foot lockers, salesmen's sample cases, chests which house workmen's tools or musical instruments, etc. Examples of velcro-type interengageable pile-surfaced sheet material can be seen in U.S. Pat. Nos. 2,717,437 and 2,820,277. It will also be appreciated that the bifurcate ends 64, 66 of the slide yoke 68 may form a loose engagement with the slide length of the rotatable tracks or ribbons 40, 42 as seen in FIG. 7, in order to avoid binding of the yoke during its travel along the track length. That is, the pair of helical curvatures of the two tracks do not have to be formed precisely identical; the two rollers 60, 62 do not have to emerge or retract at absolutely identical rates as long as the result is that they are completely projected at one end of travel and completely housed at the opposite end; at such terminal positions the ribbons 40, 42 may be slightly thickened to ensure a snug fit with the yoke, as seen in FIG. 3.

I claim:

1. A generally rectangular hand-carryable container comprising a pair of wide walls edgewise-connected by narrow encircling walls collectively defining a storage enclosure, the container having handle means for manually carrying the same when the wide walls are disposed in upright position, manual guidance and tow means carried in juxtaposition with an inner face of one wide wall and extensible and retractable lengthwise from a first transverse end thereof, extensible and retractable roller means located adjacent an opposite transverse end of said wide wall, and operating means connecting the roller means with said guidance and tow means and responsive to extension and retraction of the tow means for shifting the roller means between a position of non-projection from the container and an extended, functional, ground-support position for the container wherein the container may support objects placed upon the second wide wall when disposed in transverse position and the whole rollingly pushed or pulled by the extended manual guidance and tow means, said operating means comprising at least one elongated, parallel-faced, rigid ribbon pivotally carried adjacent said one wide wall and rotatable along its longitudinal axis to form a helical slide track, one end of which track is connected to said roller means in position for shifting it between non-projecting and extended positions upon rotation of the ribbon, said operating means including means connected to said guidance and tow means for at least partially rotating said ribbon and comprising a bifurcate, transverse engagement member disposed for movement lengthwise along the ribbon in sliding engagement with said parallel faces, in response to extension and retraction of said guidance and tow means.

2. A container according to claim 1 wherein said operating means comprises a pair of said twisted, rotatable ribbons disposed mutually parallel, each of which is slidingly engagable by a bifurcate end of the transverse engagement member for sliding movement along the pair of ribbons, in response to extension and retraction of the guidance and tow means.

3. A pallet assembly adapted to support in juxtaposition with one face thereof, an object such as a container for holding travelling effects, and having adjacent an opposite face anti-friction elements which are selectively projectable and retractable, whereby such object may be moved about with the aid of said elements when in projected position and alternately slid upon said opposite face when the elements are retracted, said assembly comprising in combination:

an elongated, generally planar pallet having obverse and reverse faces, the reverse face having associated means for supportive attachment to a weight-bearing object such as a travel container, anti-friction elements comprising a pair of laterally separated rollers pivotally carried by the pallet and jointly movable between a functional position of outward projection from the obverse face and a non-functional position of retraction therefrom, and operating means for projecting and retracting both of said rollers in unison, said means comprising a pair of elongated, parallel-faced, rigid ribbons, each shaped with its length progressively helically twisted approximately a quarter turn, each ribbon carrying one of said rollers adjacent an end of the twisted length and each ribbon secured lengthwise to said pallet by longitudinally aligned bearing means adjacent each end of its twisted length, which lengths are laterally spaced apart and disposed generally parallel to each other and thus adapted by partial rotation on a longitudinal axis to effect projection and retraction of the carried rollers, and shift means for effecting projection and retraction of said rollers including a transverse yoke each end being bifurcate having a pair of ribbon-embracing surfaces each pair disposed in sliding registration with a twisted length of a different one of said ribbons and adapted by its movement lengthwise along said pair of twisted ribbons to rotate the latter in unison and thereby project and retract the rollers carried by such ribbons.

4. A hand-carryable travel container which fixedly contains the pallet assembly of claim 3, said container being formed by top, bottom and connecting side walls jointly forming a storage enclosure wherein said pallet is spaced from the bottom wall to define an operating chamber containing the pallet-carried rollers, end-mounted twisted ribbons and transverse yoke, a wall of the container providing openings adjacent an end of the operating chamber for projection and retraction of said rollers, said shift means including a tow member disposed longitudinally reciprocable within and extensible from said operating chamber and connected to the transverse yoke for operative movement of the latter lengthwise along the twisted ribbons whereby the rollers may be shifted between a chamber-housed position and a projected ground-support position, in which latter position the container may be pushed or pulled by means of the projecting tow member.

5. A pallet assembly according to claim 3 which is fixedly retained within a thin, elongated, planar-faced housing of which the obverse face of the pallet forms an external face thereof, said housing having handle means adjacent a towing end thereof, a transverse container-abutment ledge located along the opposite end extending outward from the reverse face thereof, and having wrap-around strap means extending from a longitudinal edge of the housing and adapted for overlying and fastening against the obverse housing face an article disposed in edge abutment with said ledge.

6. A pallet assembly according to claim 5 wherein said container-abutment ledge is extensibly disposed in a transverse housing sheath.

* * * * *